US009549597B2

(12) United States Patent
Meersschaert et al.

(10) Patent No.: US 9,549,597 B2
(45) Date of Patent: Jan. 24, 2017

(54) LUGGAGE CASE STRUCTURE WITH PROTRUDING LOWER PORTION

(71) Applicant: Samsonite IP Holdings S.ar.l., Luxembourg (LU)

(72) Inventors: Reinhard Meersschaert, Merelbeke (BE); Andrea Della Vecchia, Ficulle (IT)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 14/540,134

(22) Filed: Nov. 13, 2014

(65) Prior Publication Data

US 2015/0130148 A1 May 14, 2015

(30) Foreign Application Priority Data

Nov. 13, 2013 (EP) ..... 13192794

(51) Int. Cl.

| | |
|---|---|
| ***A45C 5/14*** | (2006.01) |
| ***A45C 5/03*** | (2006.01) |
| ***A45C 13/36*** | (2006.01) |
| ***A45C 7/00*** | (2006.01) |

(52) U.S. Cl.

CPC . *A45C 5/14* (2013.01); *A45C 5/03* (2013.01); *A45C 7/0022* (2013.01); *A45C 13/36* (2013.01)

(58) Field of Classification Search

CPC ..... A45C 7/00; A45C 13/00

See application file for complete search history.

(56) References Cited

U.S. PATENT DOCUMENTS

| | | | | |
|---|---|---|---|---|
| 4,262,780 | A | 4/1981 | Samuelian | |
| 5,678,666 | A * | 10/1997 | Shyr et al. | 190/102 |
| 5,875,876 | A * | 3/1999 | Wang | 190/18 A |
| 6,102,172 | A * | 8/2000 | Dercole | A45C 5/005 190/109 |
| 6,305,514 | B1 | 10/2001 | Lin et al. | |
| 6,325,189 | B1 * | 12/2001 | King et al. | 190/119 |
| 6,591,950 | B1 * | 7/2003 | Scicluna | 190/103 |
| 6,609,598 | B2 * | 8/2003 | Hsu | 190/103 |
| 6,953,110 | B2 * | 10/2005 | Santy et al. | 190/125 |

(Continued)

FOREIGN PATENT DOCUMENTS

| | | | |
|---|---|---|---|
| CN | 201451800 | U | 5/2010 |
| EP | 2873341 | A1 | 5/2015 |
| WO | 2014155132 | A1 | 10/2014 |

OTHER PUBLICATIONS

Extended European Search Report of corresponding European Patent Application No. 13192794.9 dated Apr. 3, 2014, 6 pages.

*Primary Examiner* — John Walters
*Assistant Examiner* — Hilary L Johns
(74) *Attorney, Agent, or Firm* — Dorsey & Whitney LLP

(57) ABSTRACT

A luggage article having a lower portion supporting a pluralities of supports and including a plurality of walls forming a luggage case structure defining an interior cavity and having a front wall, back wall, opposing side walls, and a bottom wall, at least one support assembly being mounted on a lower portion adjacent the front wall, the lower portion of the front wall has a protruding ledge structure extending at least partially laterally across the front wall, front edges of the opposing sidewalls being offset rearwardly from the front edge of the protruding ledge structure to enhance stability.

16 Claims, 8 Drawing Sheets

(56) References Cited

U.S. PATENT DOCUMENTS

| | | | | |
|---|---|---|---|---|
| 7,467,695 | B2 * | 12/2008 | Gormick | A45C 3/02 190/102 |
| D712,662 | S * | 9/2014 | Lai | D3/321 |
| D716,555 | S * | 11/2014 | Moon | D3/318 |
| 2007/0170700 | A1 | 7/2007 | Robbins et al. | |
| 2012/0118692 | A1 * | 5/2012 | Chisholm | 190/18 A |
| 2012/0205211 | A1 | 8/2012 | Blount | |

* cited by examiner

LUGGAGE CASE STRUCTURE WITH PROTRUDING LOWER PORTION

CROSS REFERENCE TO RELATED APPLICATION

This application claims the benefit of priority to European Patent Application No. 13192794.9, filed Nov. 13, 2013 and entitled "Luggage Case Structure with Protruding Lower Portion", which is hereby incorporated by reference as though fully set forth herein.

TECHNICAL FIELD

The present disclosure relates generally to a wheeled luggage case and particularly to a luggage case with an extended base portion to enhance stability.

BACKGROUND

Luggage cases conventionally include supports, such as wheels, attached to the case to allow the case to stand on or be transported over a support surface easily during use. The supports are attached at or near the bottom of the luggage case support structure.

The supports on a luggage case are typically positioned at or near the perimeter of the bottom side wall, near the corners. The supports are mounted at or near the perimeter to provide a base having as large of an area between the supports as possible, for stability purposes. In particular, the depth dimension between the supports positioned at the front and rear edges of the bottom wall, respectively, helps determine the stability of the luggage case. This depth dimension in relation to the depth dimension of the luggage case at a location midway along the height of the luggage case largely determines whether the luggage case is stable when loaded with contents. In some conventional luggage cases, the bottom side, as well as the dimension between front and rear supports, is smaller in the depth dimension than the depth at a location midway along the height of the luggage case.

An identified problem with the conventional support location scheme is that many luggage cases may be loaded in a manner that causes instability, either by an off-center loading of the luggage case, or where the front wall extends outwardly to define a depth dimension greater than that of the supports, and thus extends beyond the location of the front supports. This can cause instability, and possibly result in the luggage case tipping over either when at rest or during transport. Using a pocket on the front wall of a luggage case, or an expandable feature on the front wall may concentrate the load at that lateral location causing the instability.

Some conventional luggage cases taper from a lesser depth dimension at a top portion to a greater depth dimension at a base. In the event this style of case tips over onto its front panel, the front panel engages the support surface along all or a majority of its length. These conventional cases, aside from having reduced packing volumes, lack a protective feature to lessen the impact and negative effect of such an occurrence, and specifically related to the lower region of the front panel and any zipper or other closure feature that may extend across the lower front portion of the front side.

Additionally, some convention luggage cases improve stability by using supports that are designed to extend beyond the perimeter of the bottom side of the luggage case, thereby increasing depth, and thus the stability. These extended supports may be structurally less sound than supports mounted more integrally with the luggage case, and also increase the outer most peripheral dimension of the luggage case without improving its packing volume.

It is therefore desirable to provide an improved luggage article, and more specifically an improved luggage case main structure, that addresses the above-described problems and/or which more generally offers improvements or an alternative to existing arrangements.

Documents that may be related to the present disclosure in that they include various means of defining the location of the supports are:

EP1718183; CN2342662Y; U.S. Pat. No. 590,893; US2011/0120828; (TW) D14465251; U.S. Pat. No. 5,423,561; U.S. Pat. No. 5,230,408; U.S. Pat. No. 6,419,198; U.S. Pat. No. 3,923,318; U.S. Pat. No. 3,871,676; U.S. Pat. No. 3,964,762; U.S. Pat. No. 3,734,527; US2013/0032558; U.S. Pat. No. 5,890,570; OHIM001770777-0001; EP0106906; EP0900031; and WO97/31550.

SUMMARY

According to the present disclosure there is therefore provided a luggage article as described in the specification and accompanying claims.

In one example of the invention a luggage case includes a front wall, a rear wall, opposing side walls, and a bottom wall. One or more support assemblies are mounted on the bottom wall. The luggage article further includes a protruding ledge formed on a lower portion of the front wall adjacent to the bottom wall and extending at least partially across a width of the front wall. A main front edge of each of the side walls is offset rearwardly behind a front edge of the protruding ledge. The protruding ledge increases the depth dimension of the base wall and improves stability, while the rearward offset of the main front edge of the side walls helps improve stability also (both together and independently from one another) by helping maintaining the center of gravity of an empty or loaded luggage case in a more rearwardly location relative to the base wall to improve stability.

Additionally, both individually and in any combination, the front edge of each side wall extends along the main lengths of the side walls; the front wall includes a pocket or an expansion feature; the protruding ledge extends across the bottom portion between the opposing side walls; the front wall defines an opening panel, and the opening panel having a bottom rim positioned above the protruding ledge. These features further enhance the stability of the luggage case.

In other examples, the support is a wheel assembly defining an axis of rotation, the wheel assembly is mounted to encompass at least a part of the ledge structure, and the axis of rotation is aligned at least between the front edge of the opposing side walls and the leading edge of the protruding ledge.

The luggage case structure for implementation of the invention may include structural support taking the form of a hybrid construction, a hard side shell, or a soft side construction.

In another example of the invention, a luggage article may include a plurality of walls forming a luggage case structure defining an interior cavity and having first opposing side walls and second opposing side walls, and defining an upper portion and a lower portion. One of the first opposing side walls in the upper portion has a lateral portion in a first configuration and a central portion extendable to a second expanded configuration. At least one support assembly is mounted on the lower portion adjacent the one wall and at least one support assembly is mounted on the lower portion adjacent the other of the first opposing side walls. The lower portion of the one wall defines a protruding ledge structure extending at least partially laterally across the one wall, the ledge structure forming a protruding apex. The at least one support assembly mounted adjacent the one wall at least partially encompassing the ledge structure. In the first configuration the lateral portion is positioned offset behind the apex, and in the second configuration the central portion is extended to near, in alignment with, or beyond the apex, and the luggage case structure remains upright. The offset may be approximately 0.1 cm to 5 cm. The ledge structure may be formed on the lower portion of the other wall, and extends at least partially laterally across the other wall. Additionally, the one wall is a front wall, and the other wall is a back side wall. The ledge structure is at least partially positioned on the lower portion directly below the lateral portion.

The present disclosure advantageously provides enhanced stability for both empty and packed luggage cases loaded in an imbalanced manner. The ledge structure on the bottom portion of the luggage case creates rearward offset of a front edge or either or both sidewalls, and/or of lateral edges of the front wall. This offset enhances stability by making larger the base wall and corresponding position of the supports, as well as by maintaining the load in a position rearwardly from the front edge of the bottom portion. Additionally, the ledge structure provides protection to the lower portion of the front wall and the lower reaches of the zipper for the opening panel when positioned on their front wall. Further, the enhancement of the base stability by integration of the protruding ledge structure into the luggage case structure, as opposed to the wheel housing, creates an overall strengthened luggage case.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present disclosure will now be described by way of example only with reference to the following figures in which.

DETAILED DESCRIPTION

The luggage case structure 100 described herein provides improved stability by creating an increased depth dimension of the base portion 102, which in turn increases the distance between the front and rear supports. This luggage case structure 100 maintains stability of the luggage case when unloaded, or when the luggage case is loaded in an unstable manner, such as where the internal contents are located asymmetrically and the center of gravity is shifted forwardly toward the front side. In some instances, the front wall 104 extends outwardly of its normal, unexpanded position. Extension of the front wall 104 to an expanded, and unstable, position may occur by over packing the main compartment, or when the external pocket 106 on the front wall 104 of the luggage case is heavily packed, or when an expandable feature of the front wall of the luggage case is in use, or any combination of the above. Prior art luggage cases would occasionally tip over forwardly when loaded in an unbalanced manner because the content load was shifted too far forwardly relative to the particular support placement. The luggage case structure 100 described herein is designed so that the front supports are positioned to create a greater depth dimension of the lower portion. In particular, a lower portion of the front wall of the luggage case has a protruding ledge, on which the supports are positioned. The front edges of the opposing side walls are offset rearwardly of a leading edge of the protruding ledge. This relative difference in location between the protruding ledge and the front edges of the sidewalls maintains the load placement in the luggage case, and its center of gravity, in a more rearwardly location to improve stability.

Figure 1:
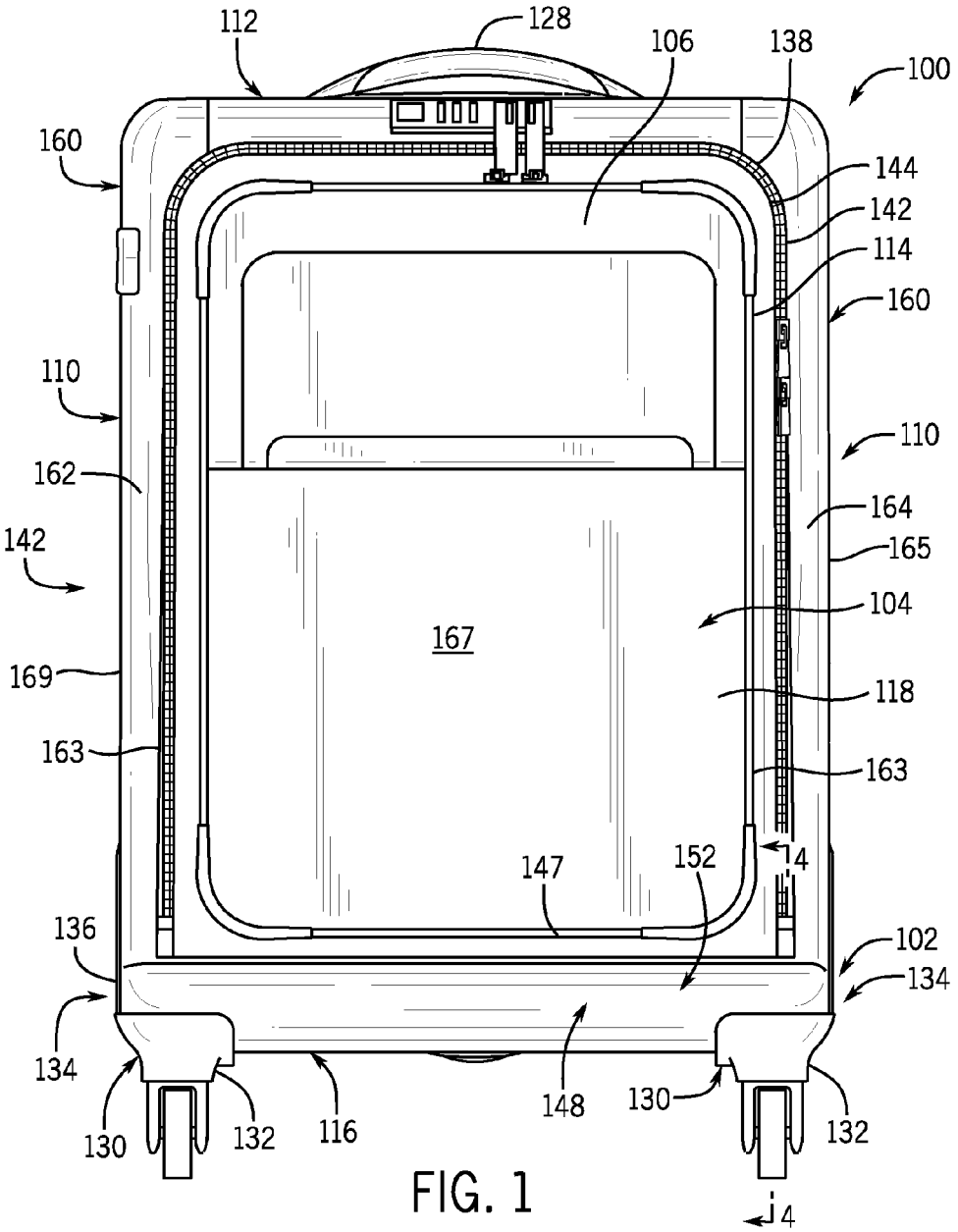
FIG. 1 is a front elevation view of a luggage case incorporating the ledge structure in a lower region.

Referring to FIGS. 1 and 2, a wheeled luggage article according to an example of the invention includes a generally cuboid or parallel-piped luggage case structure 100 formed from opposing front 104 and rear 108 walls, opposing side walls 110, and opposing top 112 and bottom 116 end walls that collectively define the outer structure 100 of the luggage case structure 100. The luggage article may be hard sided, soft sided, or a hybrid construction of both hard and soft sided structure.

The luggage article 100 may be split along an opening line 114 into a lid section 118, also referred to as an opening panel, and a base section 120. The lid section 118 may be formed entirely in the front wall 104, such as in hybrid or soft sided configuration, or may be formed of the front wall 104, and portions of the opposing side walls 110 and opposing top 112 and bottom 116 end walls, as in a hard sided configuration. The base section 120 is formed generally of the balance of the luggage case structure 100 not forming the lid section 118. The lid section 118 may be connected to the base section 120 along a portion of a side of the luggage article by a hinge in a conventional manner, and the luggage article may be opened, such as by a zipper 122 at the opening line 114 to access the internal volume.

The luggage case may include a telescoping tow handle 126 and/or fixed carry handles 128. The telescoping handle 126 and the fixed carry handles 128 may be associated with any wall of the luggage article.

The luggage case may include at least one support element 130, which may take the form of fixed foot or wheel assembly 132. The depicted luggage article includes four wheel assemblies 132 mounted from the bottom wall 116 of the case structure 110. Each spinner wheel assembly 132 is located proximate a bottom end corner 134 of the luggage case structure 100, and at or near the perimeter 136 of the bottom wall 116. As explained in more detail below, the spinner wheel assemblies 132 may be spaced apart from one another by substantially the width and/or depth of the article. In other embodiments the wheel assembly 132 may be attached to the article 100 at other locations.

The luggage case structure 100 may include an expandable feature 138, for example positioned between the base 120 and the lid 118, and provides the user with additional internal volume. The expandable feature may include a gusset 140 of material attached around at least a portion of a rim 142 of the luggage base 120 (such as but not limited to at least a portion of 3 sides). The expandable feature 138 may be retained and hidden or actuated by a selectively releasable closure mechanism 144, such as a zipper. When the expandable feature 138 is not in use, the front wall 104 is in an unexpanded or first position such as one example shown in FIG. 2A. When the expandable feature 138 is in use, the front wall 104 may expand outwardly as permitted by the structure of the gusset 140 to an expanded or second position (See FIG. 2B). The gusset 140 may be tapered (shown), parallel or varied along its length.

Figure 2A:
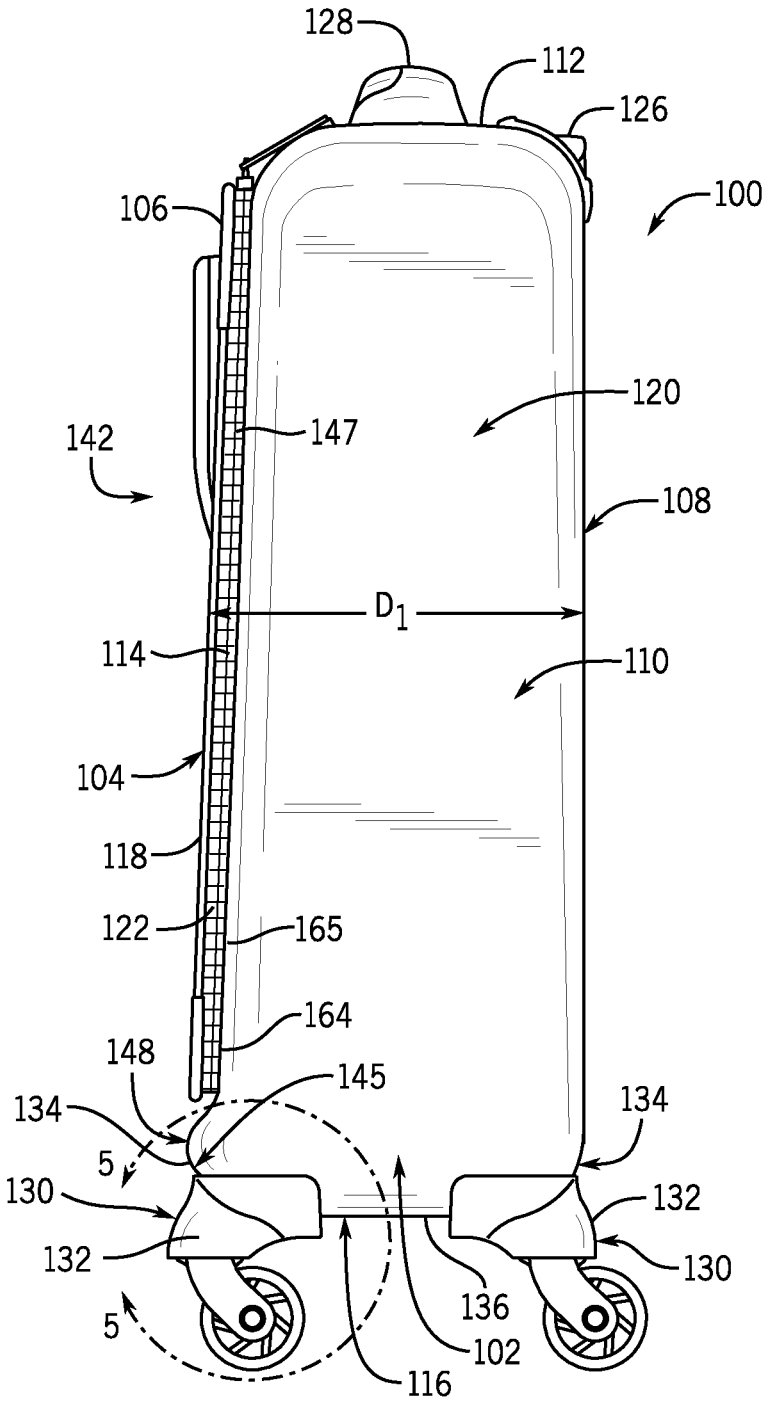
FIG. 2A is a side elevation view of the luggage case of FIG. 1 incorporating the ledge structure in a lower region.
Figure 2B:
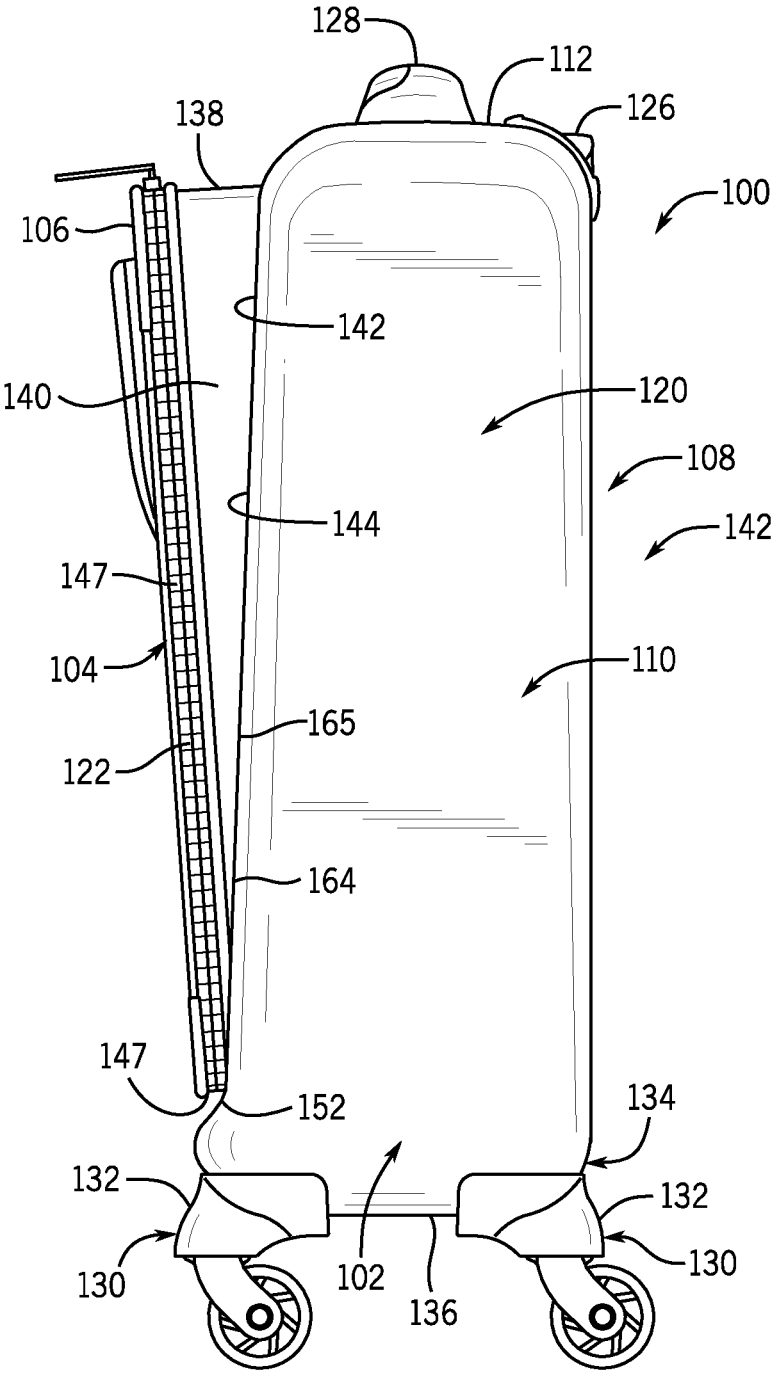
FIG. 2B is a side elevation view similar to FIG. 2A, showing the front wall in an expanded configuration.
Figure 3:
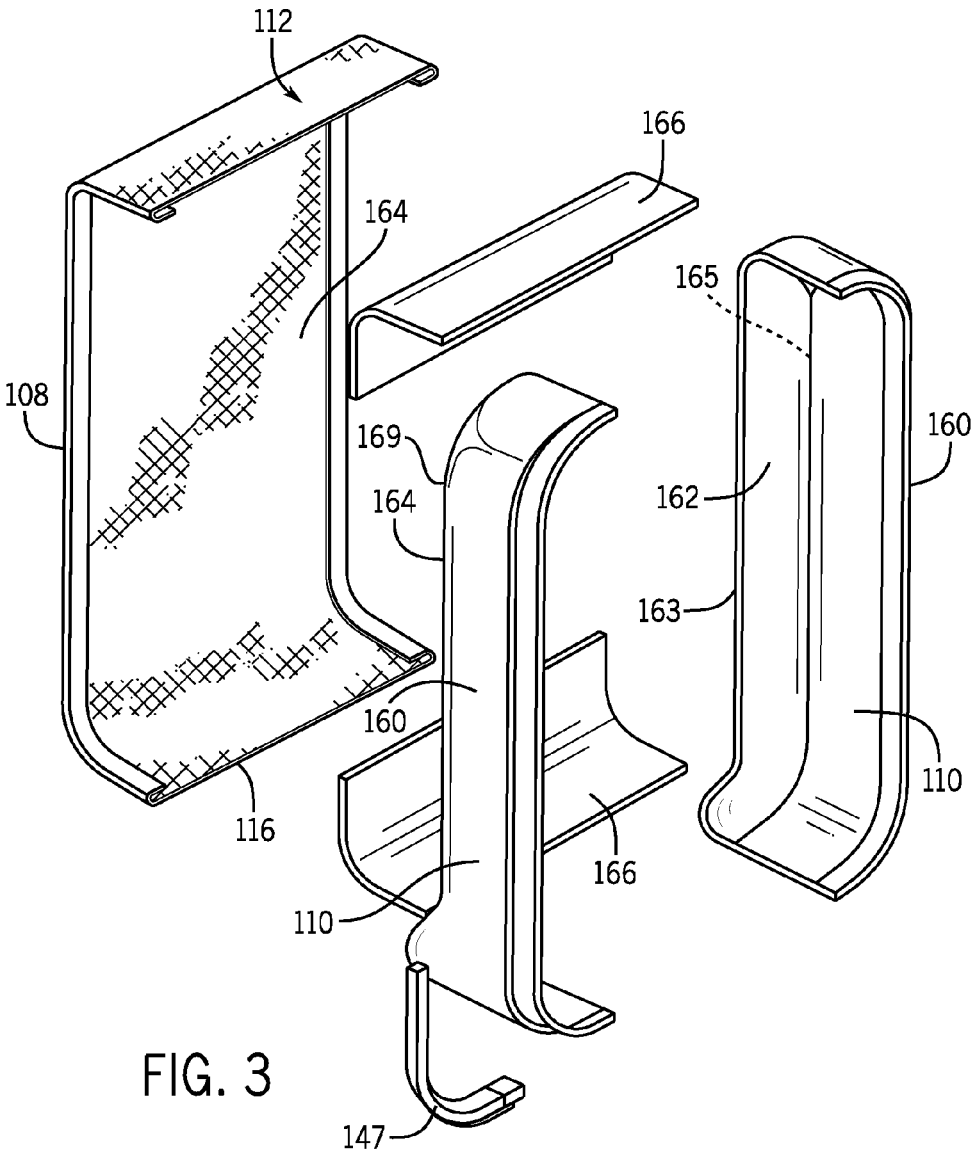
FIG. 3 is a partial exploded view of a hybrid luggage case structure.

The luggage case structure 100 described herein relative to FIGS. 1 through 7 is with reference to a hybrid luggage case structure, such as the one depicted in part in FIG. 3. Generally, a hybrid luggage case structure includes opposing molded lateral side portions 160 forming the opposing side walls 110, opposing top 112 and bottom 116 end walls, and vertically-extending front edges 165, 169 (at or near the transition from the side wall to the front wall), that extend along the main length (height) of both opposing side walls. Vertically extending edge portions 162, 164 extend along the main length (height) of both of the front 104 and rear 108 side walls (See FIGS. 1 and 2A), and are adjacent to the front edges 165 and 169. The edge portions 162, 164 are, for example, formed on the front wall 104 and extend from the perimeter (i.e. front edges 165, 169) inwardly a width dimension, such as to the inner edge 163 of the lateral side portions (in FIG. 3). The molded lateral side portions 160 are made of hard side material, which is formed or molded in a conventional manner. The molded lateral side portions, as well as the vertically extending lateral edge portions are somewhat rigid, being hard side material. The central portion of each of the front 104 and rear 108 side walls are made of soft-side material structures 167 to extend between the vertically extending lateral edge portions 162, 164 of the molded lateral side walls 160. The front wall 104 in an unexpanded position is generally planar, with the central section engaging the lateral edge portions 162, 164 and remaining in approximately the same plane. Support structure layers, such as the honeycomb sheets 166 shown in FIG. 3, and described in more detail below, as well as fewer or more layers, may be used as is conventionally known, to provide support along the bottom wall 116 and the top end wall 112. Note that the edge portions may, in some examples, be strips of material (plastic or fabric or other layer or laminate) positioned along peripheral portions of a soft sided luggage case, having a width of a less than a centimeter to approximately 8 cm, depending on the size and design of the luggage case. The edge portions may be formed of the same material as the central portion of the front wall, or may be formed of one or many different materials. The edge portions 162, 164 may also extend horizontally in some embodiments, or both horizontally and vertically. The edge portions are typically stiffer than the central portion of the front wall, and restrict to some extent the deflection or bowing outwardly of the central portion when over-packed with contents. This feature helps the luggage case structure efficiently utilize internal volume relative to the external dimension, which may be important for satisfying certain luggage size restrictions. The edge portions may only be found on one edge of the front (or other) side wall, or may be symmetrically, or asymmetrically on opposing edges as described herein.

Figure 5:
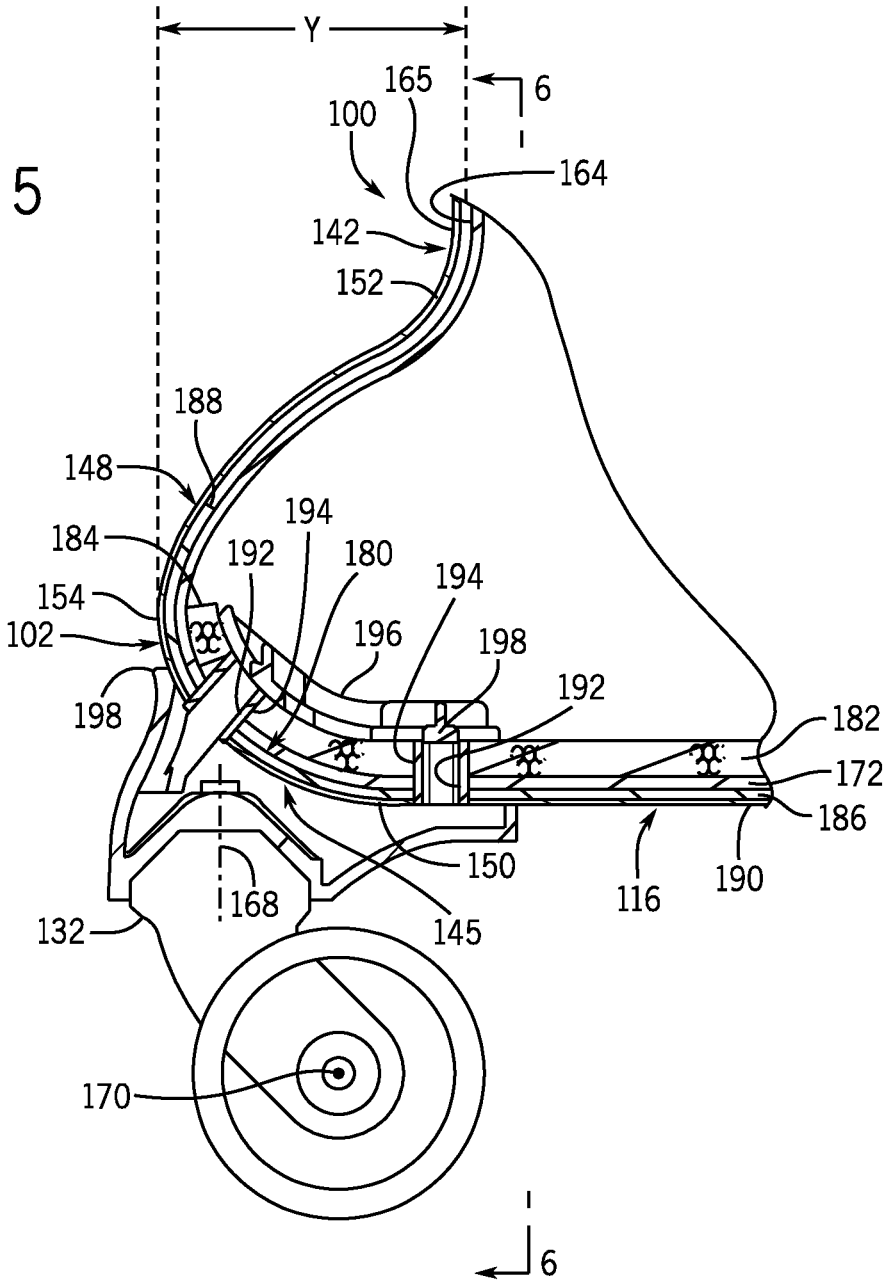
FIG. 5 is a section view taken along line 5-5 of FIG. 2A.

Referring to FIG. 5, the luggage case structure 100 is divided into an upper portion 142 and a lower portion 102. The lower portion 102 includes a lower region 145 of the front wall 104 (extending upwardly from the bottom wall) and portions 146 of the bottom wall 116 adjacent to the lower region 145 of the front wall 104. The lower portion 102 includes a ledge structure 148, which in one example extends across the width of the front wall 106 of the luggage case (see FIG. 1). The ledge structure 148 steps or protrudes outwardly away from the general plane of the upper portion 142, forming a recognizable and pronounced shoulder or ridge feature, which creates the localized increase in the depth dimension D2. D2 is generally greater than D1. The vertical dimension (along the height of the front wall) of the ledge structure 148 may be constant or vary across the width of the luggage case structure 100, but generally is approximately 1 to 3 centimeters from its lower edge 150 to its upper edge 152, and it protrudes approximately 1 centimeter at its apex 154. These dimensions may vary as needed based on the desired increase in depth according to the expandable feature 138 and/or the front pocket 106. The ledge structure 148 also creates an increase in the perimeter in accordance with the increase of the depth dimension. As described in more detail below, the ledge structure 148 provides additional stability when the luggage case article 100 is full and the front side extends or bulges forwardly.

With continuing reference to FIGS. 1 and 2A, the upper portion 142 of the front wall 104 includes the opening panel 118 defined by the associated zipper 147. In the example of the hybrid luggage case structure, the opening panel is defined to be substantially, if not entirely, within the central section 167 of the front wall 104. The lower reaches of the zipper 147 for the opening panel 118 extends along or adjacent to the upper limits 152 of the ledge structure 148. The portion of the front wall 104 of the luggage case structure 100 above the ledge structure 148, including the opening panel 118 and the lateral edge portions 162, 164, in the normal, unexpanded first position, may be recessed or set back from the front limit or apex 154 of the ledge structure 148, which is described in more detail below. The upper limit defines the height of the ledge structure. The height of the ledge structure may be consistent across the width of the ledge structure, or the height may vary across the width. A varying width may provide clearance for features on the front panel side, such as pockets or the like. Also, the ledge structure may be located at opposing lateral portions of the lower portion, positioned below the lateral side portions 162, 164.

This area of the front side 104, including the region of the opening panel 118 adjacent the lower part of the zipper 147, may be protected by the front ledge 148 in the event the luggage case is positioned on its front side 104. The vertical dimension of the ledge structure 148 is generally limited by the location of the opening panel zipper track 147. The ledge structure 148 may have a taller vertical dimension where the zipper track 147 defines an opening panel 118 having a shorter overall height.

As shown in FIG. 2A, in the normal or unexpanded first configuration the luggage case structure 100 defines a depth dimension D1 between the front edge 165, 169 of the sidewalls 110 and the rear wall 108, and a width dimension between the opposing side walls 110. The edge portions 162, 164 may be positioned in general vertical alignment with the front edges 165, 169, and thus also define a depth dimension D1 relative to the rear wall 108. The front edges 165, 169 of the sidewalls may be positioned to be offset rearwardly from the leading edge of the ledge structure. The edge portions 162, 164 where positioned in general vertical alignment with the front edges 165, 169, may be positioned offset rearwardly behind the apex of the ledge structure 148. The offset is generally measured as the difference between D1 and D2. This rearward offset dimension may be irrespective of the expansion of the front panel during packing, and the stability benefits associated with this offset feature are experienced regardless of the packed or unpacked state of the luggage case. Depending on the particular design of the luggage case structure, the central portion of the front wall 104 may be planar and in the first configuration may be positioned offset behind, vertically oriented with, or offset forwardly of the ledge structure 148, described in more detail below.

The depth dimension, as well as the perimeter dimension, at many locations along the height of the luggage case structure may increase from the first normal, or unexpanded, condition of the luggage case structure 100 to a second expanded configuration. This may occur by over-packing the main compartment to flex the front wall 104 outwardly. As shown by the dashed line in FIG. 2A, the expanded front wall bows outwardly from top to bottom, and also bows outwardly in a lateral direction between opposing sides. The deflection or expansion is typically the greatest along a vertical centerline of the front wall, as well as along a horizontal centerline extending between the opposing sidewalls. In the second, expanded, configuration of the hybrid luggage case shown in FIG. 3, the bowing or expansion occurs primarily in the central soft-sided portion 167 of the luggage case, with the front edges 165, 169 not expanding, and lateral edge portions 162, 164 remaining substantially unbowed. Thus, the expansion is focused between the lateral edge portions 162, 164. Thus, while central portion 167 of the front wall 104 may expand in the second configuration to extend to or beyond the apex 154 of the ledge structure (see FIGS. 4A, and 5), the front edges 165, 169, as well as lateral edge portions 162, 164 remain offset behind the apex of the ledge structure. This results in the overall expansion of the luggage case structure 100 including the ledge structure 148 being relatively less than if the soft side portion 167 extended from edge to edge across the complete front wall of the luggage case. While the front edges 165, 169 and edge portions 162, 164 may have similar rearward offset from the front edge or apex of the ledge portion, these structural features may not necessarily maintain the same amount of offset, depending on factors including the structure of the luggage case, materials used, and geometry.

Expansion also may occur when the external pocket 106 on the front wall 104 is heavily packed. In this case, the front pocket may cause the front wall to bow out also. Additionally, the second configuration may include when the expandable feature 138 of the front wall of the luggage case is in use (such as in FIG. 2B), which may also include the outward bowing of the front wall 104. Any combination of the above may define the second configuration of the luggage case expansion. In any of the above examples of the second configuration, the central portion 167 of the front sidewall extends out to or beyond the apex of the ledge structure, while the lateral edge portions 162, 164 remain offset behind the apex of the ledge structure 148.

In the normal or unexpanded first configuration (See FIG. 2A), the depth D1 at any location along the front edges 165, 169 and the lateral edge portions 162, 164 of the upper portion 142 is less than the depth D2 of the lower portion 102 (which includes the ledge structure 148). In the expanded second configuration (whether by use of the front pocket, expansion feature, or both (See FIG. 2B)), the front wall 104 is pushed or flexed outwardly such that at least some parts of the upper portion 142 extend to or beyond the leading edge of the ledge structure. The front edges 165, 169 and lateral edge portions 162, 164, as described above, remain substantially in position and at the rearward offset from the leading edge of the ledge structure. The effect of this is described in more detail below. The ledge structure 148 described herein may be implemented along any individual, or combination of, intersections or edges of the bottom wall 116 and front, rear, or opposing side walls. Note that the term "depth" is intended to mean the dimension in the direction parallel to the direction of instability of the luggage case structure. For instance, with respect to FIG. 2A, depth is measured between the front wall 104 and the rear side wall 108. However, depth may be used to denote the dimension between the opposing side walls 110 if the ledge structure was implemented to resist instability in the direction causing the luggage case to tip over onto one of the opposing sidewalls.

Figure 4A:
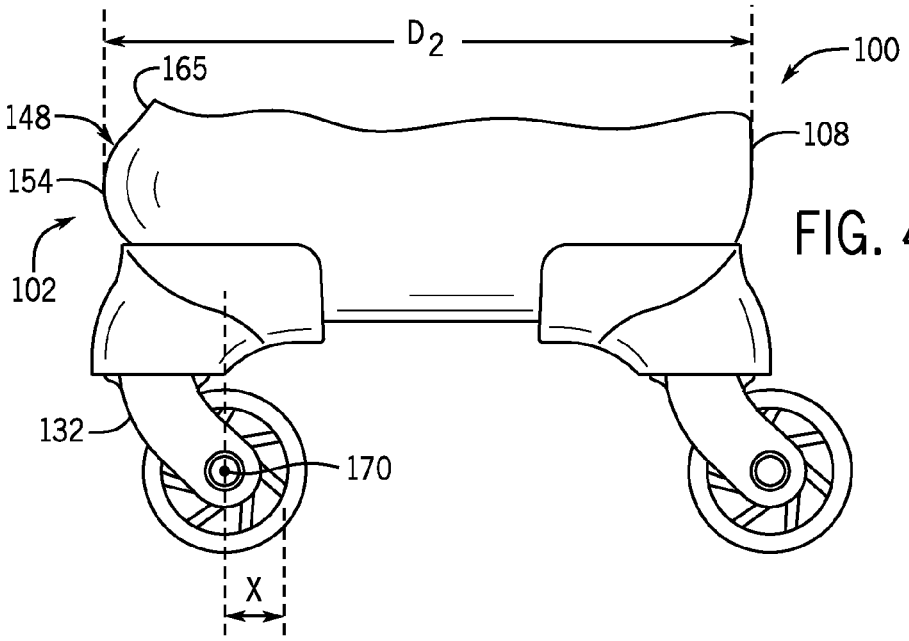
FIG. 4A is a partial side elevation view similar to FIG. 2A showing the ledge structure.
Figure 4B:
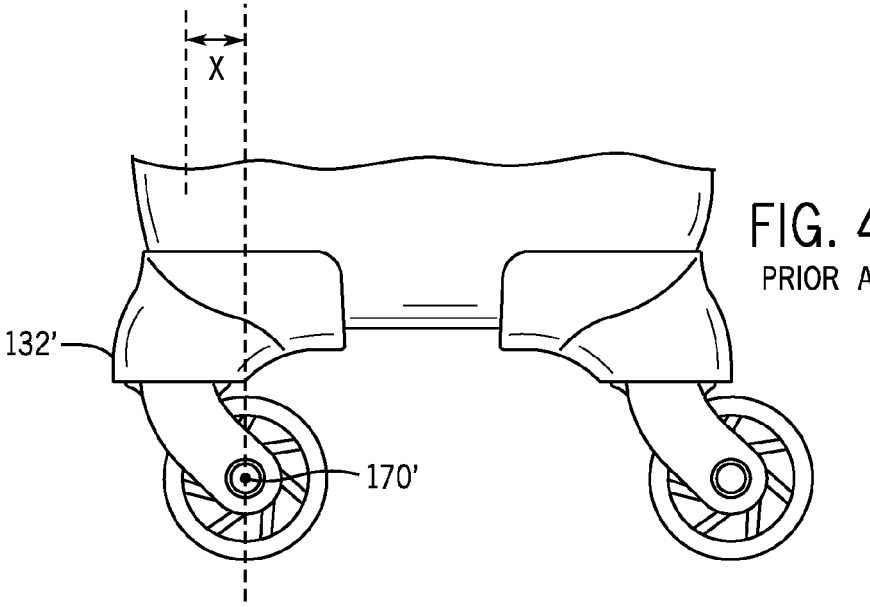
FIG. 4B PRIOR ART
FIG. 4B is a partial side elevation view of a luggage case without the ledge structure.

As shown in FIGS. 4A and 5, the ledge structure 148 is formed in the luggage case structure 100, and the wheel assembly 132 is attached to the luggage case structure 100 at or adjacent the ledge structure so as to forwardly offset the wheel assembly 132 and wheel to enhance stability. The extent of the forward protrusion of the ledge structure 148 accordingly moves the wheel assembly, the vertical spinner wheel axis 168, and the horizontal wheel axis 170 forwardly (away from the rear wall 108 of the luggage case), and to increases the depth dimension D2 of the lower portion 102, thus improving stability of the luggage case whether packed or unpacked. As can be seen in the comparison of the ledge structure 148 of FIG. 4A to the conventional luggage case shown in FIG. 4B, the ledge structure 148 offsets the wheel axis 170 forwardly compared to the location of a wheel axis 170' of a similar wheel assembly 132' mounted on a convention luggage case. The spinner wheel axis is positioned between the leading edge of the ledge structure and the offset position of the front edges 165, 169. The offset dimension X may be selected according the desired improvement in stability, and may include factors such as the general size of luggage case, the specific height, depth or width dimension; the intended use of the luggage case (such as a carry-on), typical loading characteristics, and other factors. In some examples, the ledge structure 148 protrudes forwardly of the lateral edge portions 162, 164 of the upper portion 142 of the front side 104 (the "set back") by 0.1 cm to approximately 5 cm, with an extension of approximately 1 to 2 cm having been found to be beneficial in a carry-on size luggage case.

By increasing the depth dimension of the base portion by forming the ledge structure 148 into the luggage case structure 100, as opposed to offsetting the wheel axis away by changing the shape of the wheel assembly itself, the result is a stronger overall structure. This increase in strength is due at least in part to the increase in the moment load of the luggage case not being focused on the wheel assembly itself but instead more directly on the luggage case structure. In this configuration also, the overall maximum dimension of the luggage case used for determining flight restrictions is more closely related to the capacity of the luggage case. The ledge structure 148 also protects the lower portion 102 of the lateral edge portions 162, 164 of the front wall 104 from damage; and possibly protects across the entire width of the front wall 104 depending on the expanded state of the central portion 167.

FIG. 5 is a section view of one example of the luggage case structure, taken through the bottom side 116 and the lower portion 102 of the front wall 104, at or adjacent to the front edge 165 of the side wall and adjacent lateral portion 162, and specifically shows the ledge structure 148. In this example, the ledge structure 148 at this location is formed by the hard side shell formed material layer 172. Other layers providing structural and cosmetic enhancements may include a honeycomb layer, a plastic sheet layer, and a fabric layer. More or fewer layers are contemplated. The shell layer 172 extends along at least a portion of the bottom side 116 and transitions upwardly and forwardly to shape the lower region 180 of the ledge structure 148. The shell layer 172 extends from the lower region 180 to an apex 154 of the ledge structure 148, which defines the forward-most extent of the ledge structure, and is at depth D1 from the rear wall 108. The apex 154 is shown as rounded, but may also be sharp, flat or other shape, and the shape may vary across the ledge structure as it extends laterally across the lower portion 102 of the luggage case. From the apex 154 of the ledge structure 148, the shell layer 172 continues to extend upwardly and rearwardly past the upper limit 152 of the ledge structure 148, and extends generally upwardly to the offset dimension Y (measured from the apex of the ledge structure 148) of the lateral edge portions 162, 164 of the upper portion 142 of the front wall 104, which is at a depth dimension D1 from the rear wall 108. As noted above, the offset dimension Y of the lateral edge portions 162, 164 does not substantially change from the first configuration to the second configuration of the upper portion.

A first supporting layer 182, such as the sheet of honeycomb material, extends along the bottom side 116 of the case 100 and along an upper surface of the shell layer 172. The terminal end 184 of this first supporting layer 182 may terminate at or adjacent to the apex 154 of the ledge structure, and for example may extend to a position approximately 60 degrees (from vertically down) up the front wall 104. In this hybrid structure, the terminal end 184 of the first supporting layer 182 extends the full width of the luggage case, between the separate molded lateral side portions 160 (see FIGS. 1 and 3), and defines the ledge structure 148 there along and between the lateral portions 162, 164. In some instances, a second supporting layer 186, such as the plastic sheet layer, may extend along the bottom side 118, and be positioned below the lower surface of the shell material 172, with a forward free end 188 terminating at, or adjacent to the apex 154 of the ledge structure. The free end 188 may extend to a lesser or greater extent as desired, to provide more or less coverage of the ledge structure 148. A third supporting layer 190, such as the fabric material, may cover all or a portion of the outer surface of the luggage case structure 100. In the hybrid structure as shown, the fabric material does not cover much of the molded hard side shell 172, but primarily the portion of the front 104 and rear 108 side walls extending between the molded lateral side portions 160.

The wheel assembly 132 includes, in this example, bosses 192 (two of which are shown in FIG. 5) that extend upwardly from the wheel assembly 132, through apertures 194 formed in the layer structure described above, and terminate adjacent to an internal plate 196. A fastener 198 is positioned through the internal plate 194 and is received in a respective boss 192 to secure the wheel assembly 132 to the luggage case structure 100. The front edge 198 of the wheel assembly 132 positioned on the ledge structure 148 typically extends up to but not over the apex 154. In this way the wheel assembly 132 does not significantly add, if at all, to the overall depth D2 dimension of the luggage case 100, which benefits the placement of the luggage case in tight spaces, such as overhead bins. If desired, however, the wheel assembly 132 may extend over the apex 154. Also, the wheel assembly 132' (FIG. 4B) on the conventional luggage case extends outwardly away from the front wall of that case, which negatively impacts the outer perimeter of the luggage case for fitting in tight spaces without clearly improving its stability.

Figure 6:
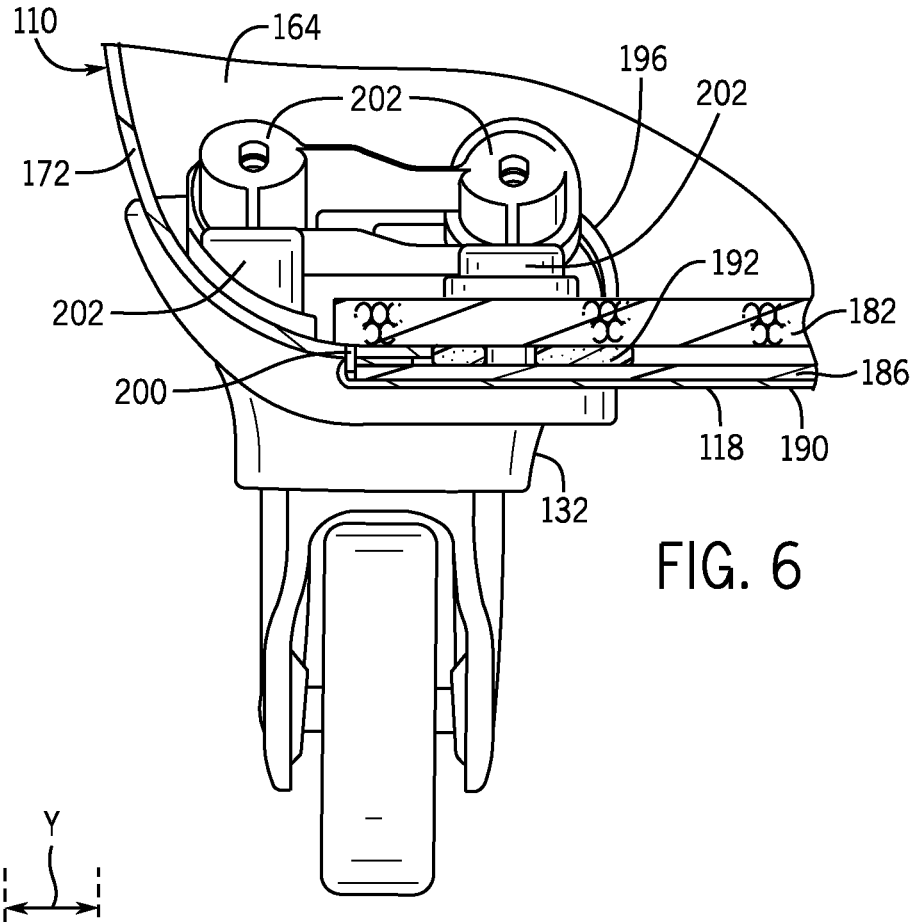
FIG. 6 is a section view taken along line 6-6 of FIG. 5.

FIG. 6 is a section view through the bottom side 118 and one opposing sidewall 110 of the structure case shown in FIG. 5. This section shows the sandwich configuration of the layers shown in FIG. 6, including the inner plate 196, first support layer 182, hard side molded shell layer 172, second support layer 186, and third support layer 190. Additionally, foam or other dampening material 192 may be positioned selectively within the layer structure to provide cushioning of the impact forces during use, as well as to help make the sandwich layer accommodate the assembly of partial layers of differing thickness. The layers are connected in a typical manner, such as by one or more stitching seams 200, fasteners, or the like. Four bosses 202 are shown in this view, extending between the wheel assembly 132 and the internal securement plate 196, securely positioning the wheel assembly 132 on the lower portion 102 of the front side 104 encompassing at least a portion of the ledge structure 148, while clamping the layers of the luggage case structure 100 together.

Figure 7:
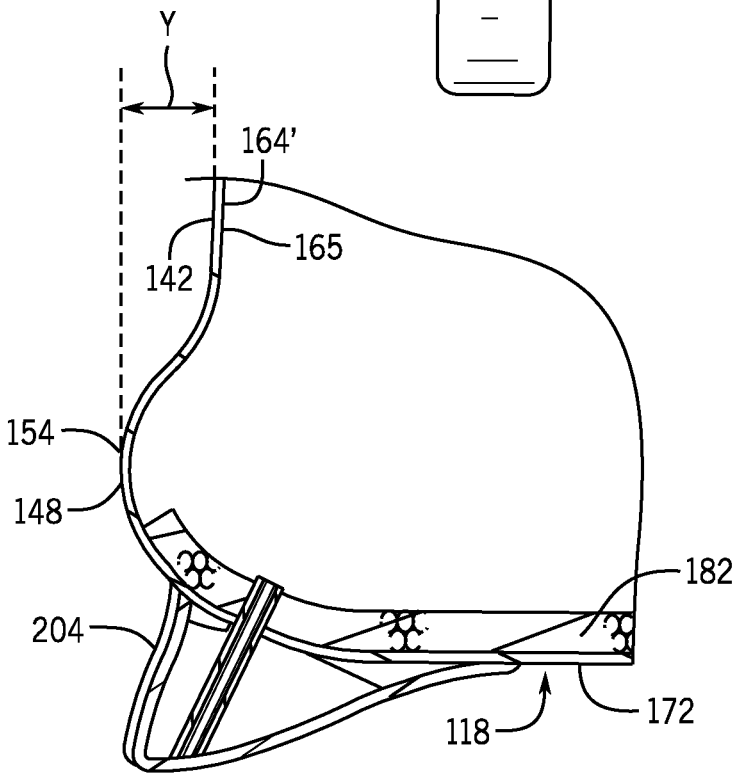
FIG. 7 is a representational section view similar to FIG. 5, showing a support having a foot configuration.

FIG. 7 shows a representative cross section of a ledge structure 148 formed in the luggage case structure 100 having an upright configuration. In an upright configuration, the supports 204 along the front edge of the bottom side 118 are feet or posts, and the supports along the rear edge of the bottom side 118 are wheels fixed in rotation only about a horizontal axis. As shown here, the ledge structure 148 is formed by the formed hard sided shell 172, with a first supporting member 182 being a honeycomb sheet herein similar to that shown in FIG. 5. The offset of the front edges 165, 169 and lateral portion 162, 164 are the same or similar to that of the embodiments shown in FIGS. 1-6. The foot support 204 is fastened to the luggage case structure 100 to encompass a portion of the ledge structure 148, and thus shifted forwardly relative to the back wall of the luggage case structure 100, establishing an increased depth dimension D2 to provide added stability.

Figure 8:
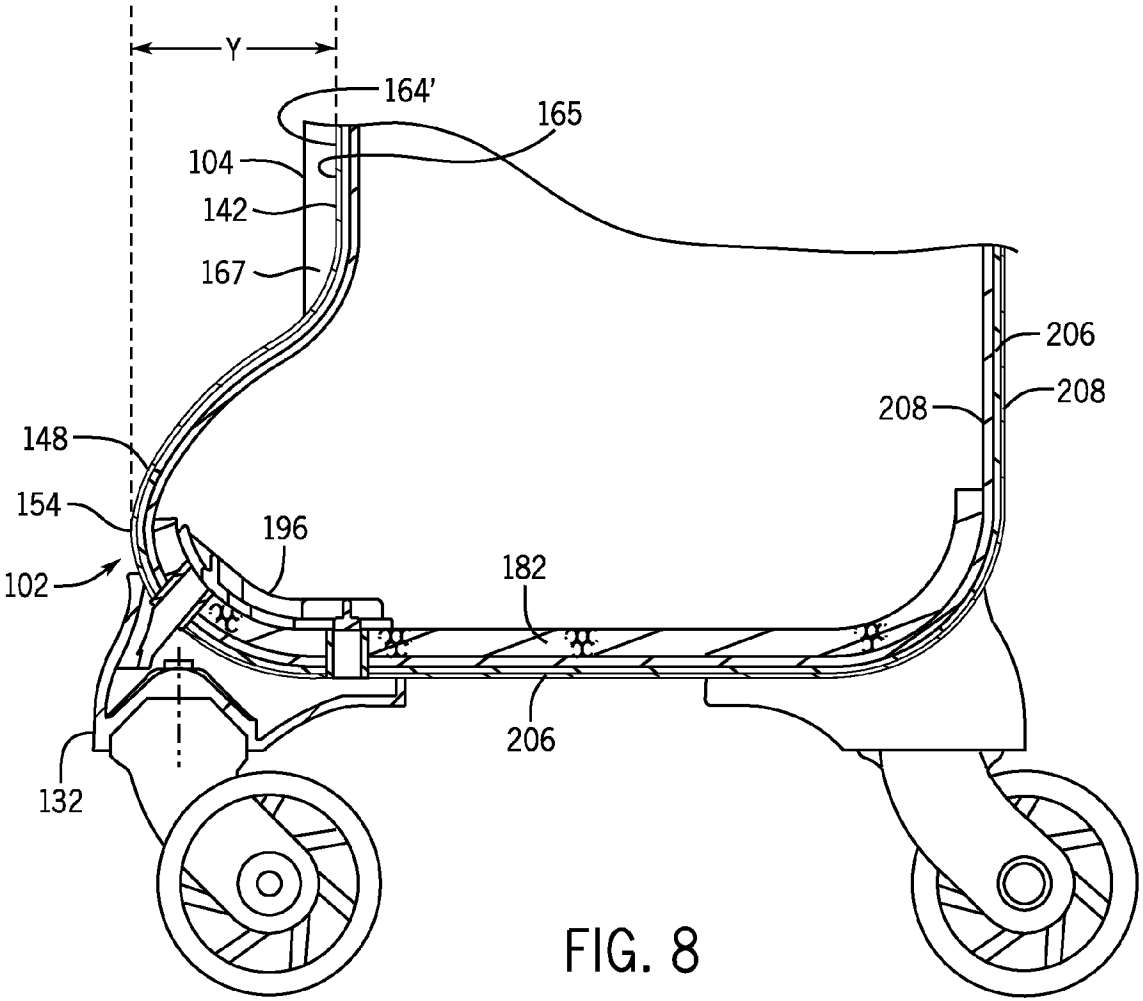
FIG. 8 is a representation section view similar to FIG. 5, showing a luggage case structure having a wire frame configuration.

FIG. 8 shows a representative cross section of the ledge structure 148 similar to those of FIGS. 5 and 7, as formed when utilized in conjunction with a soft sided luggage case. The luggage case structure of a soft sided luggage case typically employs a wire frame 206 to form the perimeter of each of the opposing side walls of the luggage case. The wire frame 206 is bent along its length to form the protruding ledge 148 and define the lower region 102 of the front wall 104. The offset of the front edge 165, 169 and lateral portion 162, 164 are the same or similar to that of the embodiments shown in FIGS. 1-6. The wire frame 206 is strong enough to maintain this shape during use, and may be housed in a sheathing structure 208. The wheel assembly 132 is positioned to encompass at least a portion of the ledge structure 148 of the luggage case housing and is thus positioned in a more forward position to increase the depth dimension of the lower portion 102 to D2. The internal supporting structure is similar to that of a typical soft side construction, including for instance the honeycomb sheet and internal mounting plate, among possible others. The wheel assembly 132 is secured to the luggage case by fasteners extending through the luggage case structure to engage an internal mounting plate, which also clamps the sandwich layers together.

The expansion of the front wall 104 in both the examples of FIGS. 7 and 8, is focused along a central vertical axis thereof, with the lateral edge 164' adjacent the perimeter of the front wall 104 (corresponding opposing lateral edge 162' is not shown in this figure) less likely to deflect towards the apex, and thus remains at substantially the offset dimension Y between the first configuration and the second configuration. The ledge structure thus provides an increased base dimension for stability, protective features for the lower edges of the lateral portions of the front wall 104, and creates an efficiency in the volume management of the deflection of the central portion of the front wall 104 by designing the rigidity of the lateral edges (such as by material type, thickness, or structure).

Relative to conventional luggage structures, the luggage case structure described herein provides a ledge structure which offsets the mounting location for wheel assemblies outwardly from the plane of the upper portion of the front wall of the luggage case to increase the depth dimension, which improves stability of an empty or fully-packed luggage case. The front wall of the luggage case structure may thus be loaded more fully, including the use of the expandable feature, with a lesser risk of instability. Additionally, the ledge structure protects the lower part of the opening panel and associated zipper if the luggage case is set down on its front wall. Further, the luggage case structure lessens the amount of shell deformation required at the bottom corners for attachment of the wheel assemblies. Further, front edges 165, 169, and also the edge portions 162, 164 are offset rearwardly from the front edge of the ledge structure, to reduce the depth of the case to help meet size restrictions set by airline and other carriers.

The luggage case structure of the present disclosure has broad application. It may also be implemented on any, some, or all lower regions of the luggage case structure to improve stability and protection of the lower region in any particular direction the luggage case may be moved on a support surface. The apparatuses and associated methods in accordance with the present disclosure have been described with reference to particular embodiments thereof in order to illustrate the principles of operation. The above description is thus by way of illustration and not by way of limitation.

All relative and directional references (including: upper, lower, upward, downward, left, right, leftward, rightward, top, bottom, side, above, below, front, middle, back, vertical, horizontal, height, depth, width, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

What is claimed is:

1. A luggage article comprising:

a front wall, a rear wall, opposing molded side walls, and a bottom wall;

at least one support element mounted on a corner of the bottom wall; and a protruding ledge formed on a lower portion of the front wall adjacent to the bottom wall and extending at least partially across a width of the front wall and forming a protruding apex;

wherein:

a front edge of each of the side walls is offset rearwards behind a front edge of the protruding ledge;

at least one support element is mounted on the lower portion adjacent the front wall and at least one support element is mounted on the lower portion adjacent the rear wall;

the at least one support element mounted adjacent the front wall is a wheel assembly defining an axis of rotation;

the wheel assembly is mounted to encompass at least a part of the protruding ledge;

the axis of rotation is aligned at least between the front edge of the front wall and the front edge of the protruding ledge; and a material layer of the protruding ledge transitions upwardly and forwardly to shape a lower region of the protruding ledge.

2. The luggage article of claim 1, wherein:

the front edge of each side wall extends along the main lengths of the side walls.

3. The luggage article of claim 1, wherein:

the front wall includes a pocket or an expansion feature.

4. The luggage article of claim 1, wherein:

the protruding ledge extends across the bottom portion between the opposing side walls.

5. The luggage article of claim 1, wherein:

the front wall defines an opening panel, and the opening panel having a bottom rim positioned above the protruding ledge.

6. The luggage article of claim 1 wherein:

the protruding apex is rounded or flat.

7. The luggage article of claim 1 wherein:

a height of the protruding ledge is consistent.

8. The luggage article of claim 1 wherein:

the rear wall is substantially perpendicular to the bottom wall.

9. The luggage article of claim 1 wherein: the axis of rotation is either a horizontal wheel axis or a vertical spinner axis.

10. The luggage article of claim 1 wherein:

at least portions of the front wall and portions of the rear wall are parallel.

11. The luggage article of claim 1 wherein:

the front wall defines a central portion extending between the side walls; and the central portion is at least partially offset forwardly of the front edges of the opposing sidewalls.

12. The luggage article of claim 1, wherein:

the protruding ledge is positioned in alignment and below the front edge of each side wall.

13. The luggage article of claim 1, wherein the offset is approximately 0.1 to 5 cm, and more preferably 1 to 2 centimeters.

14. The luggage article of claim 1, wherein at least a portion of the protruding ledge is rigid.

15. The luggage article of claim 1, wherein at least a portion of each opposing side wall is rigid and defines at least one of a portion of the protruding ledge or a portion of the bottom wall.

16. The luggage article of claim 1, wherein the luggage article is of a hybrid construction.

* * * * *